US006802442B1

(12) United States Patent
Thompson

(10) Patent No.: US 6,802,442 B1
(45) Date of Patent: Oct. 12, 2004

(54) BACKPACK HAVING A SHOULDER STRAP MOUNTED LIFT BUCKLE

(75) Inventor: Jesse Thompson, Bozeman, MT (US)

(73) Assignee: K-2 Corporation, Vashon, WA (US)

( * ) Notice: Subject to any disclaimer, the term of this patent is extended or adjusted under 35 U.S.C. 154(b) by 190 days.

(21) Appl. No.: 10/195,664

(22) Filed: Jul. 12, 2002

(51) Int. Cl.[7] ..... A45F 3/04

(52) U.S. Cl. ..... 224/637; 224/259; 224/262; 224/627

(58) Field of Search ..... 224/259, 261, 224/262, 627, 637

(56) References Cited

U.S. PATENT DOCUMENTS

| | | | | |
|---|---|---|---|---|
| 2,816,339 A | | 12/1957 | Prete, Jr. et al. | |
| 4,307,826 A | | 12/1981 | Stewart | |
| 4,318,502 A | * | 3/1982 | Lowe et al. | 224/637 |
| 5,181,638 A | | 1/1993 | McHale | |
| 5,240,159 A | | 8/1993 | Gregory | |
| 5,660,312 A | | 8/1997 | Suzuki | |
| 5,730,347 A | * | 3/1998 | Finot | 224/631 |
| 5,890,640 A | * | 4/1999 | Thompson | 224/630 |
| 5,921,435 A | * | 7/1999 | Billet | 224/148.3 |
| 5,961,019 A | * | 10/1999 | Gleason et al. | 224/643 |
| 5,975,387 A | * | 11/1999 | Gleason et al. | 224/640 |
| 6,070,776 A | * | 6/2000 | Furnary et al. | 224/627 |
| 6,290,114 B1 | * | 9/2001 | Berberian | 224/637 |
| 6,375,053 B1 | * | 4/2002 | Cecchinel | 224/267 |

* cited by examiner

*Primary Examiner*—Gary E. Elkins
(74) *Attorney, Agent, or Firm*—Christensen O'Connor Johnson Kindness PLLC

(57) ABSTRACT

A backpack having a storage compartment (134) and a shoulder strap assembly (129*a*) attached at a first end to the storage compartment at a first location (140) and coupled at a second end to the storage compartment at a second location spaced from the first location. The backpack further includes a buckle (116) attached to the shoulder strap assembly and a lift strap (118) having a first end (120) attached to the upper portion (136) of the storage compartment and spanning above the shoulder strap assembly from its location of attachment to the storage compartment to engagement with the buckle. The buckle is operable to selectively adjust the length of the lift strap to vary the proportion of the weight of the backpack supported by the shoulder strap assembly when engaged by the shoulders of a user wearing the backpack.

40 Claims, 4 Drawing Sheets

*Fig.1.* *(PRIOR ART)*

BACKPACK HAVING A SHOULDER STRAP MOUNTED LIFT BUCKLE

FIELD OF THE INVENTION

The present invention relates generally to backpacks and, more particularly, to backpacks having lift straps coupled to the shoulder straps.

BACKGROUND OF THE INVENTION

Referring to FIG. 1, most conventional backpacks 10 have a pair of shoulder strap assemblies 28 and a waist strap 42 coupled to a storage compartment 34 for holding objects to be carried upon the back of a user. The shoulder strap assemblies 28 and the waist strap 42 distribute the load of the objects carried within the storage compartment 34 upon the shoulders and waist or hips of the user. Although backpacks arranged as described are effective in assisting a user in carrying objects upon the user's back, they are not without problems. For instance, it was found that the ability to adjust the ratio of weight borne by the shoulders relative to the waist of the user was desirable. To accomplish this function, conventional backpacks have incorporated a pair of lift strap assemblies 12 which interconnect an upper portion 36 of the backpack 10 to the shoulder strap assemblies 28. By tightening the lift strap assemblies 12, a higher percentage of the load carried by the backpack 10 is borne by the waist strap 42. In contrast, by loosening the lift strap assemblies 12, a higher percentage of the load carried by the backpack 10 is carried by the shoulder strap assemblies 28.

Focusing now on the left lift strap assembly 12, a first end 20 of the lift strap 18 is rigidly affixed to the shoulder strap assembly 28 by stitching 24. The lift strap 18 then engages a buckle 16 attached to the upper portion 36 of the storage compartment 34 by a short anchor strap 14 at attachment location 26. The lift strap 18 is engaged with the buckle 16 by passing the second free end 22 of the lift strap 18 around at least one friction bar 44. The friction created by the change of direction of the lift strap 18 as the lift strap 18 encircles the friction bar 44 impedes the movement of the lift strap assembly 12 relative to the buckle until the buckle 16 is manipulated by the user.

To tighten the lift strap assembly 12, a user must raise his/her hand up above his/her head to grasp the free end 22 of the lift strap 18. Upon grasping the lift strap 18, the free end of the lift strap is forcefully pulled outward and away from the buckle 16. The force required to "shorten" the lift strap assembly 12 is substantial since the force exerted upon the free end 22 of the lift strap 18 must overcome any load on the lift strap 18 and all friction forces created by the engagement of the lift strap 18 with the friction bar 44 of the buckle 16. The harder one pulls of the lift strap, the greater the load placed upon the friction bar 44, and thus the greater the friction force that must be overcome to tighten the lift strap 18.

To "lengthen" the lift strap assembly 12, a user must reach up and above the user's head and grasp the buckle 16. The buckle 16 is then rotated to manipulate the angle which the lift strap 18 enters and exits the buckle to partially disengage the lift strap 18 from the friction bar 44, to permit the lift strap 18 to pass through the buckle 16, to lengthen the lift strap assembly 12.

Although conventional backpacks having lift straps may be effective, they are not without problems. For instance, to shorten the lift strap assembly 12, the user must exert a substantial force upon the free end 22 of the lift strap 18.

This force must be sufficiently high to overcome any load on the lift strap 18 and the friction forces exerted by the friction bar 44 as discussed above, which may result in a strain or injury to the user. Further, the shortening of the lift strap assembly 12 in the manner described above may lead to the over tightening of the lift straps 18 which may result in shoulder and chest pain if tightened to an extreme. Further still, the buckle 16 is placed in a location obscured, or at least partially obscured, from sight; therefore buckle adjustment by the user is awkward, time consuming, and potentially injury causing as the user contorts his/her body to try to view the buckle.

Many of the same disadvantages are realized when a user desires to lengthen the lift strap assembly 12. More specifically, a user must again reach up and to the side of his/her head to obtain access to the buckle 16. Further, the act of reaching up and above one's head may cause a loss of the user's balance, resulting in a fall. This is especially true when a user is wearing a large, heavily loaded backpack. Even further, if the buckle 16 cannot be viewed by twisting one's head around, manipulation of the buckle 16 must occur without visual reference, thereby making the proper operation of the buckle 16 difficult. Further still, some user's may find the physical act of reaching up above one's head difficult or impossible, especially for those having reduced mobility.

Therefore, there exists a need for a backpack having lift straps that are easy to operate, require less force to adjust, reduce the potential for over tightening, may be adjusted by a means that is easily viewed and accessed by the user, and satisfies the performance expectations of the user.

SUMMARY OF THE INVENTION

In accordance with one embodiment of the present invention, a backpack including a storage compartment and a shoulder strap assembly attached at a first end to the storage compartment at a first location and coupled at a second end to the storage compartment at a second location spaced from the first location is provided. The backpack further includes a buckle attached to the shoulder strap assembly and a lift strap having a first end attached to the upper portion of the storage compartment and spanning above the shoulder strap assembly from its location of attachment to the storage compartment to engagement with the buckle. The buckle is operable to selectively adjust the length of the lift strap to vary the proportion of the weight of the backpack supported by the shoulder strap assembly when engaged by the shoulders of a user wearing the backpack.

In accordance with further aspects of one embodiment of the present invention, the lift strap includes a second end extending beyond the buckle, wherein the buckle is operable to selectively adjust the length of the lift strap through manipulation of the second end of the lift strap. In accordance with still further aspects of one embodiment of the present invention, the buckle is actuatable between a first position, wherein the buckle prevents lift strap movement through the buckle in a first direction, and a second position, wherein the buckle permits movement of the lift strap through the buckle in the first direction. In accordance with yet still further aspects of one embodiment of the present invention, the buckle is actuatable between the first and the second positions through manipulation of a second end of the lift strap extending beyond the buckle. For instance, thebuckle may be actuatable from the first position to the second position by increasing the angle of inclination of the second end of the lift strap relative to the buckle. Or, the buckle may be actuatable from the second position to the first position by changing the angle that the second end of the lift strap extends from the buckle.

In accordance with other aspects of one embodiment of the present invention, the buckle is actuatable between a first position, wherein the buckle impedes lift strap movement through the buckle in a first direction for lengthening the lift strap, but permits lift strap movement through the buckle in a second direction opposite the first direction for shortening the lift strap, and a second position, wherein the buckle permits movement of the lift strap through the buckle in the first direction for lengthening the lift strap. In accordance with still other aspects of one embodiment of the present invention, the buckle includes a cam rotatable between a first position, wherein the cam impedes lift strap movement through the buckle in a first direction, and a second position, wherein the cam permits movement of the lift strap through the buckle in the first direction. The cam may be biased to assume the first position by an elastic member. The cam may engage the lift strap in the first position and at least partially disengage from the lift strap in the second position.

In accordance with yet still other aspects of one embodiment of the present invention, the backpack may further include a second shoulder strap assembly attached at a first end to the storage compartment at a first location and coupled at a second end to the storage compartment at a second location spaced from the first location and a second buckle attached to the second shoulder strap assembly. The backpack may also include a second lift strap having a first end attached to the upper portion of the storage compartment and spanning above the second shoulder strap assembly from its location of attachment to the storage compartment to engagement with the second buckle. The second buckle may be operable to selectively adjust the length of the second lift strap to vary the proportion of the weight of the backpack supported by the second shoulder strap assembly when engaged by the shoulders of a user wearing the backpack.

In accordance with additional aspects of one embodiment of the present invention, the backpack may further include a waist strap coupled to the lower portion of the storage compartment and operable to at least partially encircle the waist of a user. Further, the adjustment of the length of the lift strap may selectively adjust the ratio of weight carried by the shoulder strap assembly relative to the waist strap when the backpack is worn by a user. In accordance with further additional aspects of one embodiment of the present invention, the lift strap passes substantially straight through the buckle without undergoing a substantially change in direction.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 2:
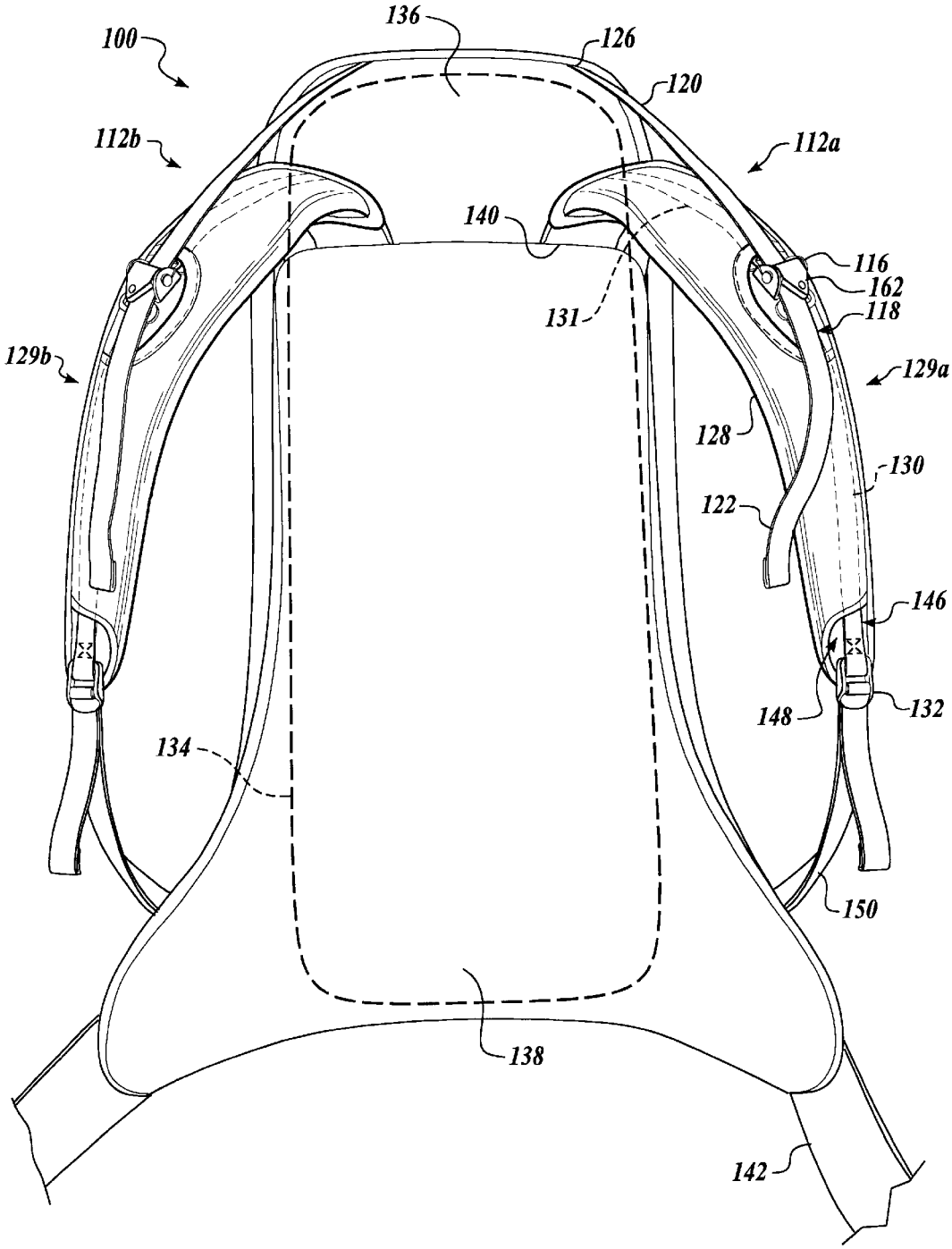
FIG. 2 is an elevation view of one embodiment formed in accordance with the present invention having a lift strap adjustment buckle attached to a shoulder strap assembly.
Figure 3:
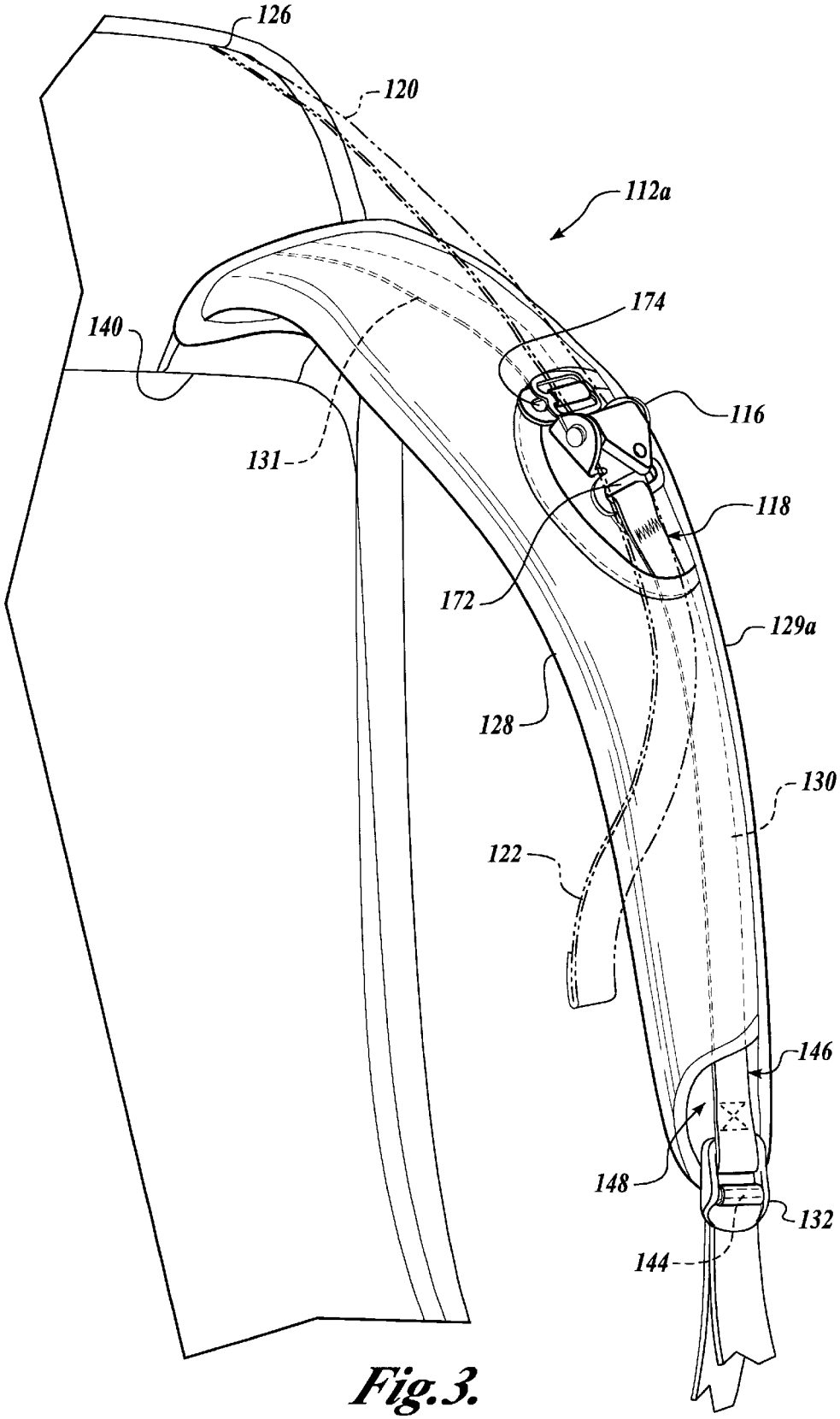
FIG. 3 is a fragmentary view of the shoulder strap assembly and a lift strap assembly of the embodiment depicted in FIG. 2.
Figure 4:
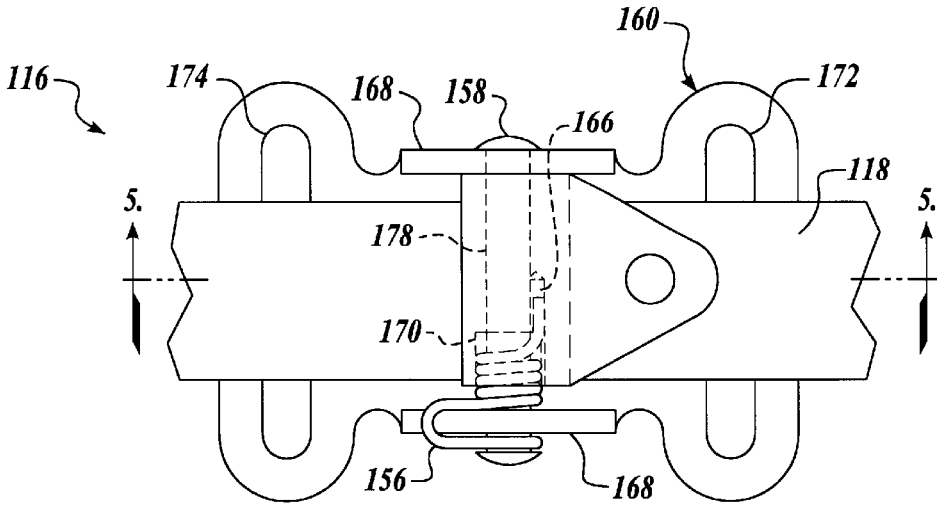
FIG. 4 is a top view of the lift strap adjustment buckle of the embodiment depicted in FIG. 2.

FIGS. 2–6 illustrate one embodiment of a backpack 100 constructed in accordance with the present invention is shown. Referring to FIGS. 2 and 3, the backpack 100 is designed to be worn upon the back of a user (not shown) to facilitate the carrying of a load. The backpack 100 includes a pair of lift strap assemblies 112*a* and 112*b*, a pair of shoulder strap assemblies 129*a* and 129*b*, and a waist strap 142, all coupled to a storage compartment 134. The storage compartment 134 defines a cavity used for the storage of objects to be carried therein. The storage compartment 134 includes an upper portion 136 and a lower portion 138. Coupled to the upper portion 136 of the storage compartment 134 at attachment location 140 is a first shoulder strap assembly 129*a*. The lower end of the first shoulder strap assembly 129*a* may be coupled to the lower portion 138 of the storage compartment 134 by stitching (not shown).

The first shoulder strap assembly 129*a* is comprised of a shoulder pad 128 having an inner channel 148 passing therethrough. A shoulder strap 146 passes through the inner channel 148 of the shoulder pad 128. The shoulder strap 146 is comprised of three sections: an upper shoulder strap section 131, a middle shoulder strap section 130, and a lower shoulder strap section 150. The upper end of the upper shoulder strap section 131 is anchored to the upper portion 136 of the storage compartment 134. The buckle 116 is mounted on the lower end of the upper shoulder strap section 131 through the use of an oval eyelet 174. The upper end of the middle shoulder strap section 130 is also coupled to the buckle 116 through a second oval eyelet 176. The lower end of the middle shoulder strap section 130 is coupled to a shoulder strap buckle 132. The lower shoulder strap section 150 is coupled to the shoulder strap buckle 132 and to the lower portion 138 of the storage compartment 134.

The shoulder strap buckle 132 is operable to adjust the length of the shoulder strap 146 to provide a comfortable fit for users of various sizes. The shoulder strap buckle 132 has at least one friction bar 144 of which the lower shoulder strap section 150 partially encircles. The friction force imposed by the friction bar 144 upon the lower shoulder strap section 150 prevents the movement of the lower shoulder strap section 150, as should be apparent to one skilled in the art. The "length" of the lower shoulder strap section 150 is selectively adjusted through manipulation of the shoulder strap buckle 132 to thereby adjust the length of the shoulder strap 146, as is well known in the art.

As should be apparent to one skilled in the art, the construction and operation of the first shoulder strap assembly 129*a* is substantially similar to that of the second shoulder strap assembly 129*b*, therefore for brevity, discussion of the second shoulder strap assembly 129*b* has been omitted. Likewise, each of the lift strap assemblies 112*a* and 112*b* are substantially similar in construction and operation, therefore for brevity, only one lift strap assembly 112*a* will be discussed in detail following.

Focusing now on the lift strap assemblies 112*a* and 112*b*, the first lift strap assembly 112*a* includes a lift strap 118 having a first, upper end 120 and a second free end 122. The upper end 120 of the lift strap 118 is anchored to the upper portion 136 of the storage compartment 134 at attachment location 126. The lift strap 118 spans above the shoulder strap assembly 129*a* from its attachment location 126 on the storage compartment 134 to a buckle 116 mounted on the shoulder strap assembly 129. The upper end 120 of the lift strap 118 is defined by the portion of the lift strap 118 extending between the attachment location 126 and the buckle 116. The free end 122 of the lift strap 118 is defined by the portion of the lift strap 118 extending outward from the buckle 116.

Referring to FIGS. 3–6, the buckle 116 of the lift strap assembly 112*a* will now be described in further detail. The buckle 116 includes a flat base 160 and a pair of parallel sidewalls 168 spaced from one another and extending perpendicularly from the base 160. The first oval eyelet 174 is formed at a first end of the base 160. The first oval eyelet 174 facilitates the attachment of the upper shoulder strap section 131 thereto. The second oval eyelet 172 is formed at the second, opposite end of the base 160 for facilitating the coupling of the middle shoulder strap section 130 thereto. Oriented perpendicular to and spanning between the two sidewalls 168 is a pivot pin 158. The pivot pin 158 axles a strap engagement member, such as a cam 154, thereon.

The cam 154 is comprised of a manually graspable actuation lever 162 projecting from the body portion 180 of the cam 154. The body portion 180 is cylindrically shaped and has a bore 178 passing concentrically therethrough to receive the pivot pin 158. The body portion 180 of the cam 154 further includes a jaw portion 164. The jaw portion 164 may include a toothed or otherwise textured surface 182, designed to frictionally engage the lift strap 118 against the base 160 by "pinching" the lift strap 118 between the base 160 and the cam jaw.

Figure 5:
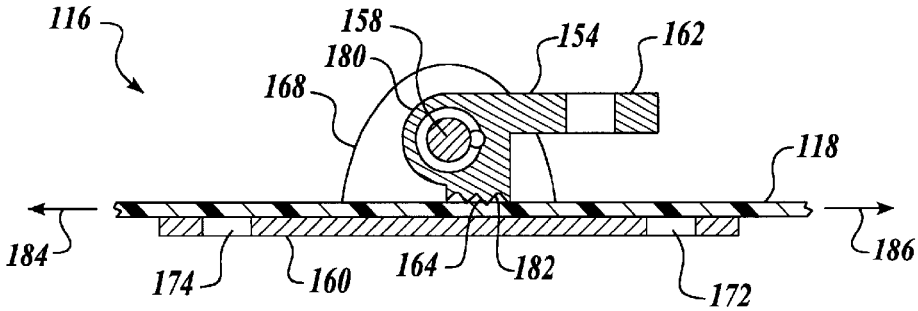
FIG. 5 is a cross sectional view of the lift strap adjustment buckle depicted in FIG. 4, the cross section taken substantially through SECTION 5—5, with a cam for engaging a lift strap shown in an engaged position.

The cam 154 may be biased in an engaged position, such as shown in FIG. 5, by an elastic member, such as a torsion spring 156 as shown in the illustrated embodiment. A first end of the torsion spring 156 is coupled to the cam 154 by insertion of an end of the spring 156 in a spring keeper 166. The opposite end of the torsion spring 156 engages one of the sidewalls 168 and the pivot pin 158 to prevent rotation of the second end of the spring 156. The cam 154 is preloaded by the torsion spring 156 so as to bias the cam in the engaged position.

With the cam 154 in the engaged position, as shown in FIG. 5, the lift strap 118 is prevented from traveling in a first "release" direction as indicated by the arrow identified by the reference numeral 184. More specifically, a tension imposed upon the lift strap 118 in the release direction 184 tends to rotate the cam 154 in a clockwise direction, thereby causing the textured surface 182 of the jaw of the cam 154 to pinch and hold the lift strap 118 between the base 160 and the cam jaw so as to prevent the "lengthening" movement of the lift strap 118 in the first direction 184 during use.

To tighten the lift strap 118, a tension force is applied thereon in a second direction, indicated by the arrow identified by the reference numeral 186, thus rotating the cam 154 in a counter-clockwise direction. Such rotation of the cam 154 tends to disengage the strap engagement portion 164 from the lift strap 118. As the jaw of the cam 154 disengages or at least partially disengages from the lift strap 118, the lift strap 118 may be moved in the second direction (indicated by arrow 186), thereby tightening the lift strap 118. Therefore, it should be apparent to one skilled in the art, that the buckle 116 allows the movement of the lift strap 118 in a second direction 186 to tighten the lift strap assembly 112*a* while impeding the movement of the lift strap 118 in a first direction 184 to prevent loosening of the lift strap assembly 112*a* during use. It should also be apparent to one skilled in the art, that the lift strap 118 passes substantially straight through the buckle 116, providing a direct route between the lift strap 118 attachment location 126 and the free end 122 of the lift strap 118. As a result, the force required to tighten the lift strap 118 is reduced from conventional backpacks, since the lift strap 118 does not make any friction creating changes of direction, such as around a buckle friction bar, as in conventional backpacks.

Figure 6:
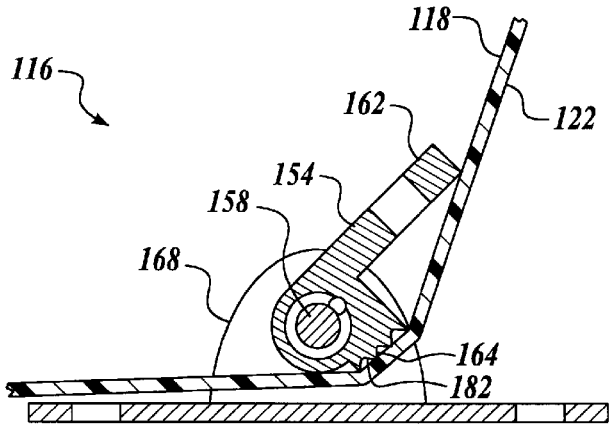
FIG. 6 is a cross section view of the lift strap adjustment buckle depicted in FIG. 4, the cross section taken substantially through SECTION 5—5, with the cam for engaging the lift strap shown in a disengaged position.

To permit travel of the lift strap 118 in the first, loosening direction 184, the cam 154 may be rotated in a counter-clockwise direction to the disengaged position, depicted in FIG. 6. In the disengaged position, the cam 154 has been rotated a sufficient angular displacement so that the jaw 164 of the cam 154 no longer sufficiently compresses the lift strap 118 between the base 160 and the teeth 182 of the strap of the cam jaw to impede movement. Thus, the lift strap 118 may now travel in the first direction 184 to loosen the lift strap assembly 112*a*.

As depicted in FIG. 6, the lift strap 118 itself may be used to actuate the cam 154 between the engaged and disengaged positions. More specifically, the free end 122 of the lift strap 118 may be pulled up and outward to increase the angle of inclination of the free end 122 relative to the buckle 116. In doing so, the free end 122 of the lift strap 118 bears against the distal end of the lever 162, thereby rotating the cam 154 from the engaged position depicted in FIG. 5, to the disengaged position depicted in FIG. 6. By then decreasing the tension on the lift strap 118, the load of the backpack 100 will pull the lift strap 118 in the first direction 184. The movement of the lift strap 118 is partially restrained by the engagement of the lift strap 118 with the jaw 164 and with the distal end of the lever 162, thus allowing the user to slowly and precisely loosen the lift strap 118.

As should be apparent to one skilled in the art, the cam 154 may also be actuated by manual manipulation of the lever 162. More specifically, a user may reach up and simply push upwardly on the distal end of the lever 162 thereby rotating the cam 154 in a counter-clockwise direction. This toggles the cam 154 from the engaged position depicted in FIG. 5 to the disengaged position depicted in FIG. 6. As the cam jaw is released or partially released from contact with the lift strap 118, the lift strap will be pulled through the buckle in the first direction 184 by the load of the backpack 100.

Referring to FIG. 2 and in light of the above description of the components of the backpack 100, the operation of the backpack will now be described. To don the backpack 100, a user places his/her left arm through the first shoulder strap assembly 112*a* and his/her right arm through the second shoulder strap assembly 112*b*. The waist strap 142 is placed around the waist of the user and fastened. The length of the shoulder strap assemblies 112*a* and 112*b* are adjusted through manipulation of the shoulder strap buckles 132 to obtain a comfortable fit. The lift strap assemblies 112*a* and 112*b* may then be manipulated to adjust the ratio of weight borne by the shoulders relative to the waist or hips of the user. More specifically, by tightening the lift strap assemblies 112*a* and 112*b*, a higher percentage of the load carried by the backpack 100 is borne by the waist strap 142. In contrast, by loosening the lift strap assemblies 112*a* and 112*b*, a higher percentage of the load carried by the backpack 100 is carried by the shoulder strap assemblies 129*a* and 129*b*.

To shorten the lift strap assemblies 112*a* and 112*b*, a user grasps the readily accessible free ends 122 of the lift straps 118 and simply pulls. When a sufficient amount of the load has been transferred to the hips of the user through the waist strap 142, the user ceases pulling and the buckle 116 automatically engages and holds the lift straps 118 in the desired position. To loosen the lift strap assemblies 112*a* and 112*b*, the user reaches over and "lifts up" the lever 162 of the buckle 116 to allow the lift strap 118 to retract through the buckle 116. The lift strap 118 is then tightened to the proper tension as described above. Alternately, the lift strap 118 may be loosened by grasping the free end 122 of the lift strap 118, and increasing the angle of inclination of the lift strap 118 until the lift strap 118 engages and lifts the lever 162 of the buckle 116 to allow the lift strap 118 to pass through the buckle 116 in a loosening direction. While maintaining the increased angle of inclination of the lift strap 118 relative to the buckle 116, the user may slowly and precisely lengthen the lift strap assembly 112 until the desired shoulder load is obtained.

Figure 1:
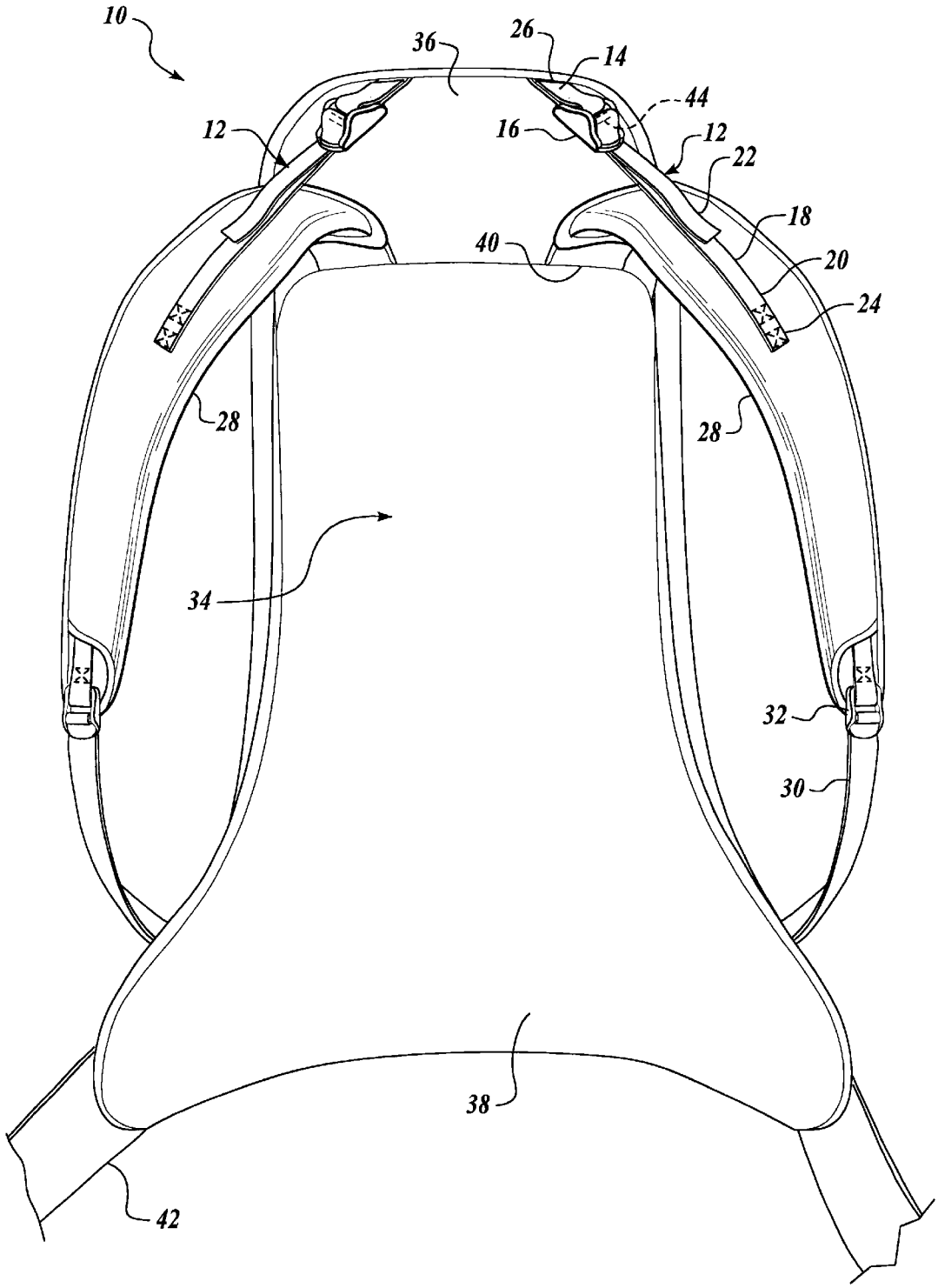
FIG. 1 is an elevation view of a prior art backpack having a lift strap adjustment buckle attached to an upper portion of the backpack.

As apparent to one skilled in the art, the lift strap assemblies 112*a* and 112*b* of the present invention reduce the potential for over tightening of the lift strap assemblies 112*a* and 112*b*. Referring to FIG. 1, prior art devices permit the tightening of the lift strap assemblies 12 to an extreme degree, such as where buckle 16 is in contact with stitching 24 of the first end 20 of the lift strap 18, potentially causing discomfort and/or injury to the user. In contrast, in the illustrated embodiment, the buckle 116 is not drawn toward the lift strap 118 attachment location 126 by a pulley effect (in the manner of the buckle 16 of the prior art backpack 10), which might permit the easy over tightening of the lift strap 18 to occur.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A backpack comprising:

(a) a storage compartment;

(b) a shoulder strap assembly attached at a first end to the storage compartment at a first location and coupled at a second end to the storage compartment at a second location spaced from the first location;

(c) a buckle attached to the shoulder strap assembly;

(d) a lift strap having a first end attached to the upper portion of the storage compartment and spanning above the shoulder strap assembly from its location of attachment to the storage compartment to engagement with the buckle; and (e) wherein the buckle is operable to selectively adjust the length of the lift strap to vary the proportion of the weight of the backpack supported by the shoulder strap assembly when engaged by the shoulders of a user wearing the backpack.

2. The backpack of claim 1, wherein the lift strap includes a second end extending beyond the buckle, wherein the buckle is operable to selectively adjust the length of the lift strap through manipulation of the second end of the lift strap.

3. The backpack of claim 1, wherein the buckle is actuatable between a first position, wherein the buckle prevents lift strap movement through the buckle in a first direction, and a second position, wherein the buckle permits movement of the lift strap through the buckle in the first direction.

4. The backpack of claim 3, wherein the buckle is actuatable between the first and the second positions through manipulation of a second end of the lift strap extending beyond the buckle.

5. The backpack of claim 4, wherein the buckle is actuatable from the first position to the second position by increasing the angle of inclination of the second end of the lift strap relative to the buckle.

6. The backpack of claim 4, wherein the buckle is actuatable from the second position to the first position by changing the angle that the second end of the lift strap extends from the buckle.

7. The backpack of claim 1, wherein the buckle is actuatable between a first position, wherein the buckle impedes lift strap movement through the buckle in a first direction for lengthening the lift strap, but permits lift strap movement through the buckle in a second direction opposite the first direction for shortening the lift strap, and a second position, wherein the buckle permits movement of the lift strap through the buckle in the first direction for lengthening the lift strap.

8. The backpack of claim 1, wherein the buckle includes a cam rotatable between a first position, wherein the cam impedes lift strap movement through the buckle in a first direction, and a second position, wherein the cam permits movement of the lift strap through the buckle in the first direction.

9. The backpack of claim 8, wherein the cam is biased to assume the first position.

10. The backpack of claim 8, wherein the cam is biased to the first position by an elastic member.

11. The backpack of claim 8, wherein the cam engages the lift strap in the first position and at least partially disengages from the lift strap in the second position.

12. The backpack of claim 1, further including:

(a) a second shoulder strap assembly attached at a first end to the storage compartment at a first location and coupled at a second end to the storage compartment at a second location spaced from the first location;

(b) a second buckle attached to the second shoulder strap assembly;

(c) a second lift strap having a first end attached to the upper portion of the storage compartment and spanning above the second shoulder strap assembly from its location of attachment to the storage compartment to engagement with the second buckle; and (e) wherein the second buckle is operable to selectively adjust the length of the second lift strap to vary the proportion of the weight of the backpack supported by the second shoulder strap assembly when engaged by the shoulders of a user wearing the backpack.

13. The backpack of claim 1 further comprising a waist strap coupled to the lower portion of the storage compartment and operable to at least partially encircle the waist of a user.

14. The backpack of claim 13, wherein adjustment of the length of the lift strap selectively adjusts the ratio of weight carried by the shoulder strap assembly relative to the waist strap when the backpack is worn by a user.

15. The backpack of claim 1, wherein the lift strap passes substantially straight through the buckle without undergoing a substantially change in direction.

16. A backpack comprising:

(a) a storage compartment;

(b) a shoulder strap assembly attached at a first end to the storage compartment at a first location and coupled at a second end to the storage compartment at a second location spaced from the first location;

(c) a buckle mounted on the shoulder strap assembly;

(d) a lift strap having a first end anchored to the upper portion of the storage compartment and spanning above the shoulder strap assembly from its location of attachment to the storage compartment to engagement with the buckle, wherein the buckle is operable to selectively adjust the length of the lift strap to vary the proportion of the weight of the backpack supported by the shoulder strap assembly when engaged by the shoulders of a user wearing the backpack;

(e) wherein a strap engagement member of the buckle is biased to assume a first position, wherein the strap engagement member impedes lift strap movement through the buckle in a first direction; and (f) is actuatable to a second position, wherein the strap engagement member permits movement of the lift strap through the buckle in the first direction.

17. The backpack of claim 16, wherein the strap engagement member is actuatable between the first and second positions through manipulation of a second end of the lift strap extending beyond the buckle.

18. The backpack of claim 17, wherein the buckle is actuatable from the first position to the second position by increasing the angle of inclination relative to the buckle of a second end of the lift strap extending outward from the buckle.

19. The backpack of claim 18, wherein the strap engagement member is actuatable from the second position to the first position by changing the angle of the second end of the lift strap that extends from the buckle.

20. The backpack of claim 16, wherein the strap engagement member is a cam rotatable between a first position, wherein the cam impedes lift strap movement through the buckle in a first direction, and a second position, wherein the cam permits movement of the lift strap through the buckle in the first direction.

21. The backpack of claim 16, wherein the strap engagement member is biased to the first position by an elastic member.

22. The backpack of claim 20, wherein the cam engages the lift strap in the first position and at least partially disengages from the lift strap in the second position.

23. The backpack of claim 16, further including:

(a) a second shoulder strap assembly attached at a first end to the storage compartment at a first location and coupled at a second end to the storage compartment at a second location spaced from the first location;

(b) a second buckle attached to the second shoulder strap assembly;

(c) a second lift strap having a first end attached to the storage compartment and spanning above the second shoulder strap assembly from its location of attachment to the storage compartment to engagement with the second buckle, wherein the second buckle is operable to selectively adjust the length of the second lift strap to vary the proportion of the weight of the backpack supported by the second shoulder strap assembly when engaged by the shoulders of a user wearing the backpack;

(d) wherein a second strap engagement member of the second buckle is biased to assume a first position, wherein the strap engagement member impedes second lift strap movement through the second buckle in a first direction; and (e) is actuatable to a second position, wherein the second strap engagement member permits movement of the lift strap through the second buckle in the first direction.

24. The backpack of claim 16 further comprising a waist strap coupled to the lower portion of the storage compartment and operable to at least partially encircle the waist of a user.

25. The backpack of claim 24, wherein adjustment of the length of the lift strap selectively adjusts the ratio of weight carried by the shoulder strap assembly relative to the waist strap when the backpack is worn by a user.

26. The backpack of claim 16, wherein the lift strap passes substantially straight through the buckle without undergoing a substantially change in direction.

27. A backpack comprising:

(a) a storage compartment;

(b) a shoulder strap assembly attached at a first end to an upper portion of the storage compartment at a first location and coupled at a second end to the storage compartment at a second location spaced from the first location;

(c) a buckle attached to the shoulder strap assembly;

(d) a lift strap having a first end attached to the upper portion of the storage compartment at an attachment location, wherein the lift strap extends from the attachment location to pass substantially straight through the buckle without undergoing a substantial change in direction; and (e) wherein the buckle is operable to selectively adjust the length of the lift strap to vary the proportion of the weight of the backpack supported by the shoulder strap assembly when engaged by the shoulders of a user wearing the backpack.

28. The backpack of claim 27, wherein the lift strap includes a second end extending beyond the buckle, wherein the buckle is operable to selectively adjust the length of the lift strap through manipulation of the second end of the lift strap.

29. The backpack of claim 27, wherein a strap engagement member of the buckle is actuatable between a first position, wherein the strap engagement member prevents lift strap movement through the buckle in a first direction, and a second position, wherein the strap engagement member permits movement of the lift strap through the buckle in the first direction.

30. The backpack of claim 29, wherein the strap engagement member is actuatable between the first position and the second position through manipulation of a second end of the lift strap extending beyond the buckle.

31. The backpack of claim 30, wherein the strap engagement member is actuatable from the first position to the second position by changing the angle that the second end of the lift strap extends from the buckle.

32. The backpack of claim 31, wherein the strap engagement member is actuatable from the second position to the first position by decreasing the angle of inclination of the second end of the lift strap relative to the buckle.

33. The backpack of claim 27, wherein the strap engagement member is actuatable between a first position, wherein the strap engagement member impedes lift strap movement through the buckle in a first direction for lengthening the lift strap, but permits lift strap movement through the buckle in a second direction opposite the first direction for shortening the lift strap, and a second position wherein the strap engagement member permits movement of the lift strap through the buckle in the first direction for lengthening the lift strap.

34. The backpack of claim 27, wherein the strap engagement member is a cam rotatable between a first position, wherein the cam impedes lift strap movement through the buckle in a first direction, and a second position, wherein the cam permits movement of the lift strap through the buckle in the first direction.

35. The backpack of claim 34, wherein the cam is biased to assume the first position.

36. The backpack of claim 34, wherein the cam is biased to the first position by an elastic member.

37. The backpack of claim 34, wherein the cam engages the lift strap in the first position and at least partially disengages from the lift strap in the second position.

38. The backpack of claim 27, further including:

(a) a second shoulder strap assembly attached at a first end to the storage compartment at a first location and coupled at a second end to the storage compartment at a second location spaced from the first location;

(b) a second buckle attached to the second shoulder strap assembly;

(c) a second lift strap having a first end attached to the upper portion of the storage compartment at an attachment location, wherein the second lift strap extends from the attachment location to pass substantially straight through the second buckle without undergoing a substantial change in direction; and (d) wherein the second buckle is operable to selectively adjust the length of the second lift strap to vary the proportion of the weight of the backpack supported by the second shoulder strap assembly when engaged by the shoulders of a user wearing the backpack.

39. The backpack of claim 27 further comprising a waist strap coupled to the lower portion of the storage compartment and operable to at least partially encircle the waist of a user.

40. The backpack of claim 39, wherein adjustment of the length of the lift strap selectively adjusts the proportion of the weight of the backpack supported by the shoulder strap assembly relative to the waist strap when the backpack is worn by a user.

* * * * *

UNITED STATES PATENT AND TRADEMARK OFFICE
Certificate

Patent No. 6,802,442 B1 Patented: October 12, 2004

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Jesse Thompson, Port Orchard, WA (US); Geoffrey E. Rittmeyer, Ojai, CA (US); and Zachary D. West, Seattle, WA (US).

Signed and Sealed this Nineteenth Day of February 2008.

NATHAN J. NEWHOUSE
*Supervisory Patent Examiner*
Art Unit 3727